United States Patent [19]

Hern et al.

[11] 4,129,325

[45] Dec. 12, 1978

[54] DOOR LATCH

[75] Inventors: John F. Hern, Southfield; Joseph L. Buccellato, Warren, both of Mich.

[73] Assignee: Massey-Ferguson Inc., Detroit, Mich.

[21] Appl. No.: 813,906

[22] Filed: Jul. 8, 1977

[51] Int. Cl.[2] ..... E05C 3/30

[52] U.S. Cl. ..... 292/127

[58] Field of Search ..... 292/127, 227, 221, 119

[56] References Cited

U.S. PATENT DOCUMENTS

| | | | |
|---|---|---|---|
| 1,954,500 | 4/1934 | Sparks | 292/127 |
| 3,044,287 | 7/1962 | Pelcin | 292/127 X |
| 3,602,536 | 8/1971 | Gamble | 292/127 |
| 3,650,554 | 3/1972 | Tharp | 292/127 |

*Primary Examiner*—Richard E. Moore

*Attorney, Agent, or Firm*—W. R. Nolte

[57] ABSTRACT

A door latch for a cab whereby a door is held in the open position by the latch which is operative by a handle passing through the cab having linear motion to operate a pawl having pivotal motion for engaging a detent on the door. Further, the handle mounting is a compact one with biasing means and a seal thereon all enclosed within a segment of the cab wall.

2 Claims, 4 Drawing Figures

DOOR LATCH

The present invention relates to a latching device and more particularly to a cab door latch, such as for the cab of a vehicle.

More emphasis is being placed today on safety requirements for operators of vehicles as well as environmental and health protection for the operators all of which increase the demand for enclosures for vehicles particularly industrial tractors to protect the operator from noise, as well as falling objects, while at the same time providing a dust free often times conditioned atmosphere in which the operator may function. There are, however, occasions where the door of such a cab is desired to be maintained open while the operator is within the cab and for such instances latches are provided to maintain the cab doors open to free the operator for directing operations of the vehicle. In the past such devices have been operative from outside the vehicle cab requiring the operator to stop the machine, exit the machine, and often times even walk around the door in order to disengage the latching device. Clearly this is an inconvenience to the operator as well as a waste of an operators time. Often times the door latch was placed above and adjacent the rear wheel of the vehicle making it dangerous for the operator to approach it without shutting off the vehicle engine. Further, present day cabs being air-conditioned and sealed against dirt as well as noise present a problem for latching mechanisms which would be operative from inside the cab for a device mounted on the outside to maintain the door in the open position. It is desirable that such latch mechanisms be sealed against dirt and sound for the operating condition when the door on the cab is closed.

The present latching mechanism addresses itself to the above problems and more particularly to the latching mechanism operable from within a cab for a device to engage a door on the outside of the cab which latching mechanism is compact and easy to operate. The latch device includes a handle and means, such as a collar attached to a panel of the wall of the cab for mounting the handle thereon which mounting means supports the handle for linear movement within the cab wall in which it slides. The handle has a first end with a handle grasp located within the cab and a second end extending from the other side of the cab wall to straddle the wall of the cab. The wall contains the biasing means, in the form of a spring, for biasing the handle relative to the wall. A pawl is pivoted in a mount on the outside of the cab wall and has a portion thereof operative to engage a detent on the door. The engaging portion of the pawl is in the form of a hook with inclined portions thereon. The inclined portions include a hook and relief surface on the pawl. Means connecting the end of the handle opposite the hand grasp, such as an arm pivotally connected to the handle to interconnect the pawl and handle. The arm preferably has a lost motion movement to permit the linear motion of the handle within said wall while actuating the pivotal movement of the pawl.

Preferably the lost motion connection is a slot within the arm and the pawl has a further incline surface in addition to that of a hook for providing automatic engagement of the latching device upon contact of the door when swung to the open position. The mounting for the handle includes reinforcement internal to the cab wall to enhance the compactness of the latching device, and a seal for the linear motion for the handle is provided to militate against entry of dirt and noise to the cab where the handle passes through the cab wall.

The above latch has the advantages of being operable to lock a door in the open position which latch is releasable from within a vehicle cab. It is operable from within the cab to release an element on the outside while being capable of maintaining the cab seal against dirt and noise for a cab so sealed, such as an air-conditioned cab. Further, the latch is particularly suited for compact mounting between the inner and outer panels of a cab. The biasing means for the latch handle is also contained within the inner and outer panels of the cab in a position which is not only concealed for more suitable appearance but guarded to prevent operator contact with the movement of the biasing means such as the coils of a spring. Another advantage of the latch is that it is biased to automatically engage and retain the door in its open position whenever the door swings into engagement with it.

The above objects and advantages of the invention will become readily apparent to one skilled in the art from reading the following detailed description of an embodiment of the invention when considered with further objects thereof in light of the accompaning drawings in which.

Figure 1:
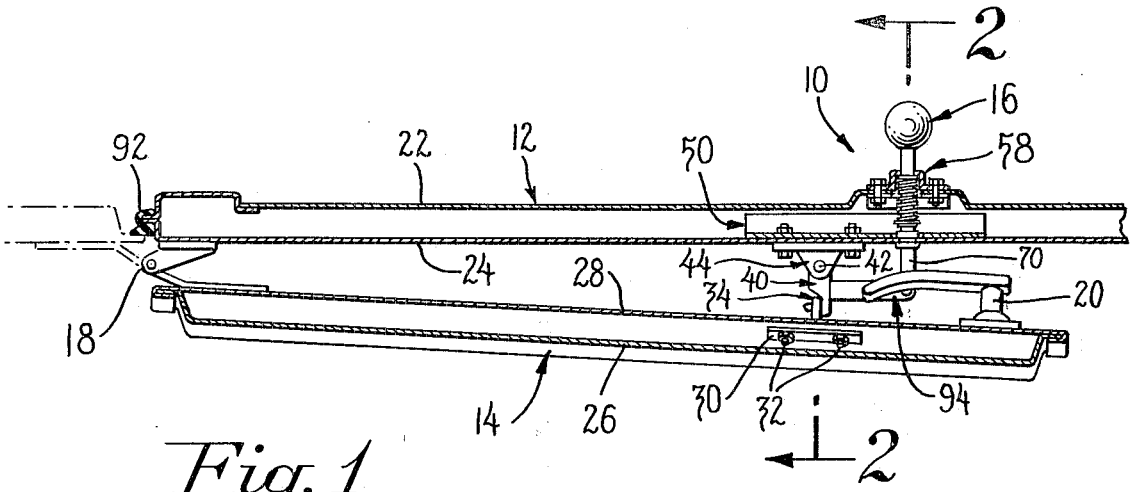
FIG. 1 is a partial sectional view looking down on top of a cab wall with a door thereof in a latched position and the cab wall embodying the latching apparatus of the present invention.

Referring to FIGS. 1-4, there is an illustration of a door latching device generally designated by the reference character 10 and shown mounted in a vehicle wall 12 which supports a vehicle door 14 with the vehicle wall 12 being only partially shown. The wall 12 could be that of a vehicle cab enclosing an operator. The latch can be seen to have a handle 16 which is operative to maintain the door 14 in an open position adjacent the side of the cab wall 12 when it is desired to maintain the door 14 in an open position. The door 14 is supported and swingable on a hinge 18 which is supported on the wall 12 and the door 14 is illustrated in phantom in FIG. 1 in a closed position while being illustrated in full in its latched position in FIGS. 1-4. The door 14 has a conventional handle 20 for maintaining the door 14 in the closed position. Both the wall 12 and the door 14 can be seen to be made up of inner and outer panels illustrated in the present embodiment as sheets 22, 24 and 26, 28, respectively. The outer sheet 28 of the door 14 can be seen to be reinforced by the plate 30 which is bolted thereto with the bolts 32 which fasten a detent in the form of a loop 34 formed of a U shaped piece of rod 36 welded or otherwise attached to a base plate 38 through which the bolt 32 passes, as can best be seen in FIGS. 2 and 3.

The loop 36 is engaged by a pawl in the form of member 40 in the embodiment illustrated being pivoted on a pin 42 retained within a member 44 welded to plate 46 which in turn is bolted by bolts 48 to the outer sheet 24 of the wall 12. The bolts 48 pass through a reinforcing member 50 having an upper flange 52 and a lower flange 54 for stiffening the reinforcing member number 50. A complementary reinforcing member 56 exists on the inner sheet 22 of the wall 12 for stiffening the inner sheet 22 where a collar 58 is bolted thereto with bolts 60. The reinforcement member 56 is similarly formed with flanges 62 to stiffen the reinforcement member 56. The collar 58 provides, together with the sheets 22 and 24 of the wall 12 mounting means for the handle 16. The collar has a neck portion 64 and opposing lugs 66 through which the bolt 60 passes to attach the collar 58 to the inner sheet 22 of the wall 12.

The handle 16 has a hand grasp in the form of the ball 68 on the end thereof located within a cab or operators compartment which is enclosed by the wall 12 while the handle 16 mid portion, rod 70, extends through the wall 12 to the outside thereof. The collar 58, inner wall 22, reinforcement member 56, outer wall 24 and reinforcement member 50 all have apertures 72 through 80, respectively, for passage of the rod 70 therethrough. A spring 82 on the rod 70 provides biasing means for the handle 16 and is located within the confines of the collar 58 and the outer wall 24 being biased when compressed together thus furnishing a force against a washer 84 affixed to the rod 70 by the retainer 85 to return the handle 16 to the position illustrated in FIGS. 2 and 3 whenever the handle 16 is in another position.

A seal in the form of a grommet 86, in the embodiment illustrated, is provided for sealing the rod 70 which slides therethrough within the outer wall 24 to militate against the entry of dirt and noise into the cab. The grommet 68 has a peripheral slot 88 for receiving the edges of the opening 78 of the outer sheet 24. The seal works in conjunction with the door 14 and window seals, such as window striping 90 of FIG. 2 to maintain the intergrity of the cab seal. The door 14 seal is illustrated in the form of stripping 92 in FIG. 1.

Figure 2:
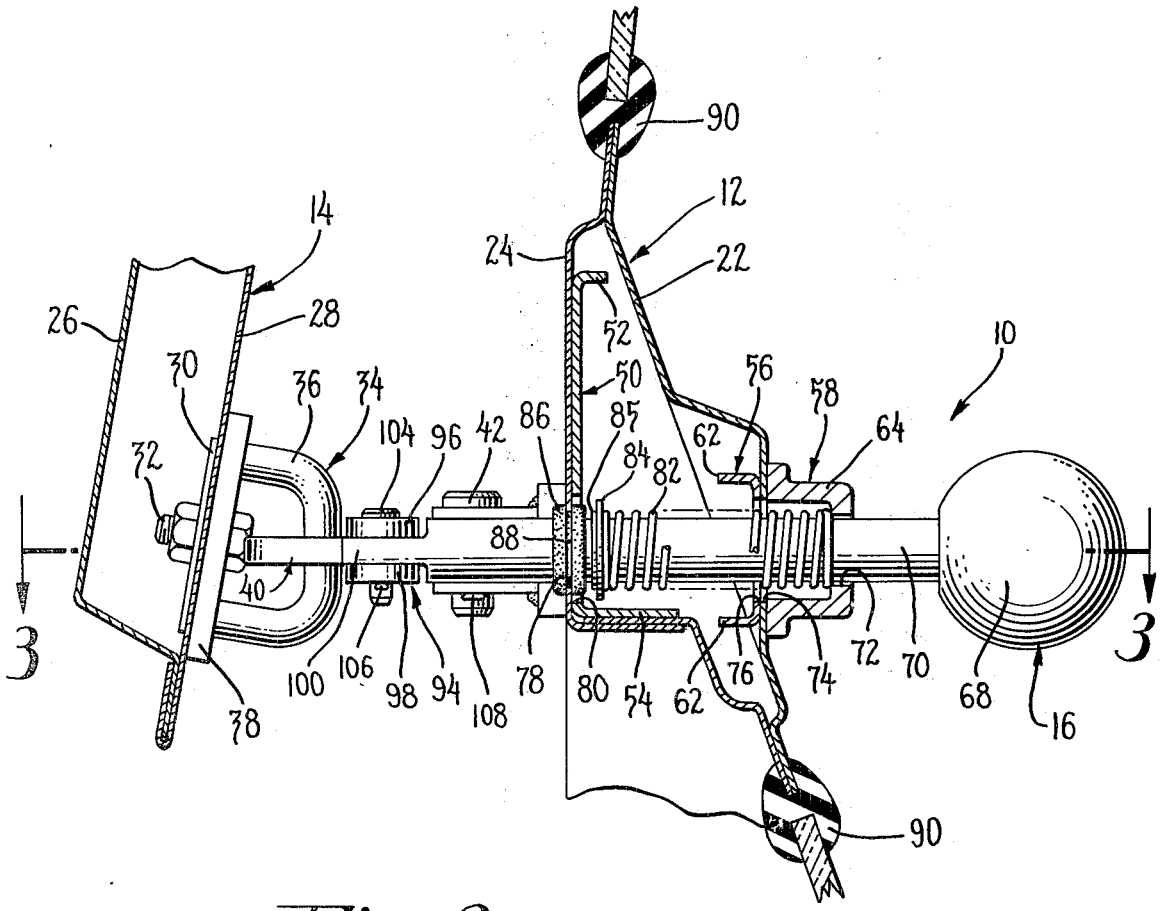
FIG. 2 is a cross sectional view of the latching apparatus of FIG. 1 taken along line 2—2 thereof.
Figure 3:
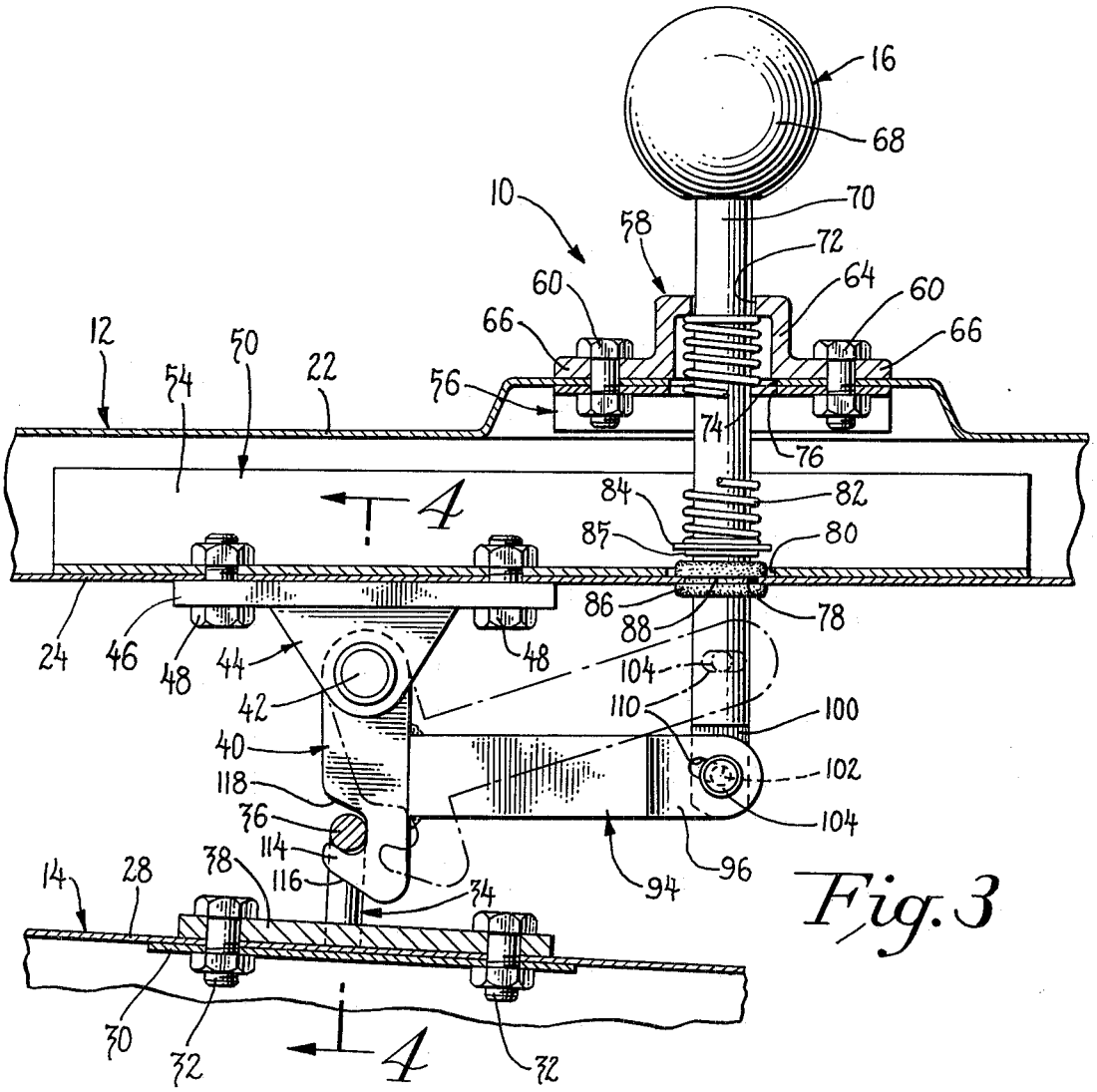
FIG. 3 is an enlarged fragmentary view of the latching device of FIG. 1.

The end of the handle 16 opposite the ball 68 can be seen to extend pass the sheet 24 and connect to an arm 94 which in turn is welded to the member 40 forming the pawl for the latch 10. The arm 94 has a bifurcated end having forks 96 and 98 passing on either side of a tongue 100 formed on the end of the rod 70 which has an aperture 102 therein for receiving the connecting pin 104 as seen in FIG. 2. The connecting pin and the pivot pin 42 for the member 40 can be seen to have retaining members 106 and 108 respectively to maintain the pins 42, 104 in their assembled condition. In FIG. 3 the arm 94 is shown in an alternate position by phantom lines. The phantom line illustration makes clear that the arm 94 has a slot 110 therein for providing a lost motion connection between the arm 94 and the shaft 70 of the handle 16. The lost motion connection accommodates pivotal movement of the member 40 under the influence of linear motion of the handle 16 in the form of the rod 70 sliding within the wall 12.

Figure 4:
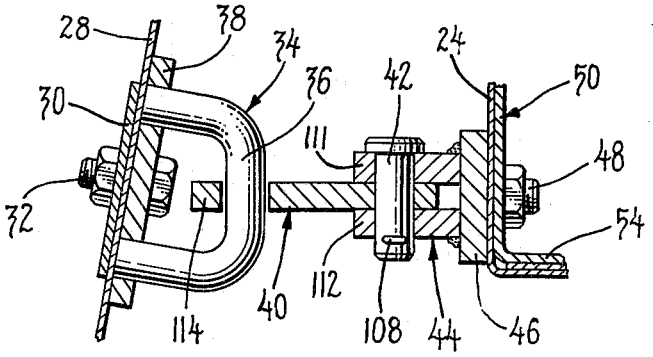
FIG. 4 is a cross section along line 4—4 of FIG. 3.

The alternate position of the arm 94 is the release position for the latch mechanism 10 and further shows the alternate or unlatched position for the member 40 which is pivotal about the pin 42. In FIG. 4 the mounting for the pin 42 is shown in greater detail. The mounting can be seen to be formed of two plates 110 and 112 which straddle the member 40 pivotal on the pin 42 retained by the plates 111 and 112 on either side of the member 40.

The member 40 forming the pawl can be seen in FIG. 3 to have a hook portion 114 at one extremity thereof for engaging the loop 34 in the latched position. Since the handle 16 biases the hook 114 to the position shown in FIG. 3, even when the door 14 is not in the latched position, it will be appreciated that the loop 34 would engage an inclined surface 116 of the member 40 whenever the door swings into engagement with the member 40. The incline surface 116 under the force of the loop 34 backed up with the weight of the door swinging into it would move the member 40 sufficiently counterclockwise to permit the loop 34 to pass the hook 114 whereupon the spring bias on the handle 16 would cause automatic engagement of the door 14 thereby locking the door 14 in the position shown in FIG. 3.

The hook 114 has a back incline surface 118 which is actually a relief to provide swinging movement pass the loop 36 with the door in the open or latched position as the member 40 swings counterclockwise.

It will be appreciated that the present latching device 10 is particularly suited to mounting within a double thickness wall wherein the inner and outer sheets 22 and 24 of the wall 12 provide not only mounting for the handle 16 through which the rod 70 slides but also provides for operation of the spring without danger of its engagement of the operator while at the same time leaving a very clean appearance to the assembly and keeping foreign matter out of engagement with the moving coils of the spring 82. The construction further takes advantage of available space for componentry, such as the spring 82, to thereby make the assembly as compact as possible.

It will be appreciated that the spacing between the inner and outer sheets 22 and 24 provides stability for sliding of the rod 70 therein over the structure of a single wall where normally a boss, or similar type bearing surface build up for a single wall, would be required for adequate sliding surface area contact between it and the handle 16.

The operation of the latching device 10 will now be described. When it is desired to operate the vehicle with the door 14 in the open position, the operator releases the door 14 with the handle 20 and swings the door 14 toward the wall 12 until the loop 34 on the door 14 engages the incline surface 116 of the member 40 pushing the member 40 sufficiently counterclockwise to allow the loop 34 to enter and be engaged by the hook 114 with the spring 82 on the rod 70 biasing the member 40 into engagement with the loop 34 as soon as the loop 34 passes the hook 114.

To release the latching mechanism 10 and close the door 14 it is only necessary for the operator to grasp the ball 68 of the handle 16 and pull the handle 16 toward him causing the rod 70 to slide relative to the wall 12 thereby compressing the spring 82 and moving the arm 94 together with the member 40 attached to it to the phantom line position illustrated in FIG. 3. The member 40 is moved out of engagement with the loop 36 thereby freeing the door 14 to be swung into its closed position where it is again latched by handle 20.

Thus it can be seen that the latching mechanism 10 provides means within an operators cab for operating a latch mounted on the outside thereof for engaging a door of a vehicle and maintaining it in an open position. The latching mechanism is compact and particularly suited for a wall composed of inner and outer panels as for a cab which is further sealed against entry of dirt and noise into the cab where the cab is one which is sealed such as for purposes of air-conditioning the same. The latching device 10 automatically engages a door swung to the open lock position by virtue of a spring bias contained within mounting means for the handle, being completely enclosed within the interior space between the inner and outer panels of the wall supporting the handle.

In accordance with the provisions of the patent statutes, the principle and mode of operation of the device have been explained and what is considered to represent its best embodiment has been illustrated and described. It should, however, be understood that the invention may be practiced otherwise than as specificly illustrated and described without departing from its spirit or its scope.

We claim:

1. A latch device comprising: a handle, inner and outer panels of an enclosure wall for supporting said handle, first and second spaced apart ends on said handle straddling said wall, said handle including a rod portion intermediate said handle ends and slidable relative to said panels, a spring attached to said handle rod portion biasing said handle relative to said panels and located therebetween, a collar on said inner panel covering a recess therein, said spring passing through said recess and abutting said collar, a pawl pivotal on said outer panel exterior, an arm attached to said pawl for movement therewith and to said handle first end, said arm having a slot therein to permit linear motion of said handle in said mounting means operative to actuate pivotal movement of said pawl to engage and disengage a detent, said handle second end manually operative from one side of said wall on said pawl located on the opposite side of said wall to cause engagement of the detent by said pawl and a seal located between said handle rod portion and said outer panel to prevent passage of dirt and noise therepast while still permitting said handle to slide within said outer panel.

2. The device defined in claim 1 wherein said pawl includes a hook portion for engaging the detent and an inclined surface for engagement by the detent to move said pawl to a position for receiving the detent to permit automatic engagement of the detent by said hook portion.

* * * * *